US005632240A

United States Patent [19]

Sihon

[11] Patent Number: 5,632,240

[45] Date of Patent: May 27, 1997

[54] APPARATUS AND METHOD FOR AN ALUMINUM ALLOY CYLINDER HEAD HAVING A VALVE GUIDE BORE WITH SPACED WEAR RESISTANT INTEGRAL SURFACES

[75] Inventor: Tanas M. Sihon, Monroe, Mich.

[73] Assignee: Chrysler Corporation, Auburn Hills, Mich.

[21] Appl. No.: 639,670

[22] Filed: Apr. 29, 1996

Related U.S. Application Data

[62] Division of Ser. No. 362,340, Dec. 22, 1994, Pat. No. 5,564,187.

[51] Int. Cl.[6] ..... F01L 3/02; F01L 3/08

[52] U.S. Cl. ..... 123/188.9; 123/188.11

[58] Field of Search ..... 123/188.9, 188.11

[56] References Cited

U.S. PATENT DOCUMENTS

| | | | |
|---|---|---|---|
| 3,799,139 | 3/1974 | Kuhn | 123/188.9 |
| 4,022,294 | 5/1977 | Coulin | 123/188.9 |
| 4,465,040 | 8/1984 | Pelizzoni | 123/188.9 |
| 5,313,917 | 5/1994 | Santi | 123/188.9 |

FOREIGN PATENT DOCUMENTS

| | | | |
|---|---|---|---|
| 3318899 | 11/1984 | Germany | 123/188.9 |
| 142817 | 6/1987 | Japan | 123/188.9 |
| 267406 | 3/1990 | Japan | 123/188.9 |

*Primary Examiner*—Erick R. Solis

*Attorney, Agent, or Firm*—Kenneth H. MacLean

[57] ABSTRACT

This application discloses an aluminum alloy cylinder head for an internal combustion engine having an integral valve stem guide bore therein with integral wear resistant end portions of the bore formed by an integrally bonded but different metal alloy for forming the wear resistant end portions.

1 Claim, 3 Drawing Sheets

APPARATUS AND METHOD FOR AN ALUMINUM ALLOY CYLINDER HEAD HAVING A VALVE GUIDE BORE WITH SPACED WEAR RESISTANT INTEGRAL SURFACES

CROSS-REFERENCE TO RELATED APPLICATIONS

This application is a division of application Ser. No. 08/362,340, filed Dec. 22, 1994 by the same inventor as in the present application, now U.S. Pat. No. 5,564,187.

BACKGROUND OF THE INVENTION

1. Field of the Invention

This application discloses an aluminum alloy cylinder head for an engine having a valve stem guide bore with integral wear surfaces of a different metal alloy to form spaced wear surfaces positioned at opposite end portions of the guide bore.

2. Description of the Related Art

In a conventional aluminum cylinder head, a tubular metal valve guide or sleeve is press fitted into a bore in the aluminum cylinder head. Without this separate valve guide, a rubbing stem portion of a valve quickly wears away at the soft aluminum or aluminum alloy of the cylinder head. This resultants in sloppy and non-axial valve movements and also the passage of relatively large quantities of lubricating oil to the engine combustion chamber by travel between the valve stem and the cylinder head.

The U.S. Pat. No. 4,723,518 to Kawasaki et al. discloses an aluminum alloy cylinder head having hardened valve seats formed by a adding a layer of a copper based alloy on the aluminum alloy. It also discloses the use of a laser beam to melt and fuse copper based alloy applied to the cylinder head in powder metal form.

SUMMARY OF THE INVENTION

The application discloses an aluminum alloy cylinder head for an internal combustion engine having a sleeveless valve guide bore. Specifically, the cylinder head has a bore with integral portions of wear resistant metal alloy different from the head's aluminum alloy. The guide bore is formed by machining pockets into the cylinder head's aluminum alloy at end of a valve guide bore. Subsequently, a metal deposit technique is utilized to fuse a powdered metal alloy to the aluminum cylinder head and fill the pockets with a copper based alloy. Subsequently, a bore through the deposited material and through the cylinder head forms a valve guide bore with a wear resistant "collar" or annullus formed at either end of the guide bore.

DESCRIPTION OF A PREFERRED EMBODIMENT

ALUMINUM CYLINDER HEAD

Figure 1:
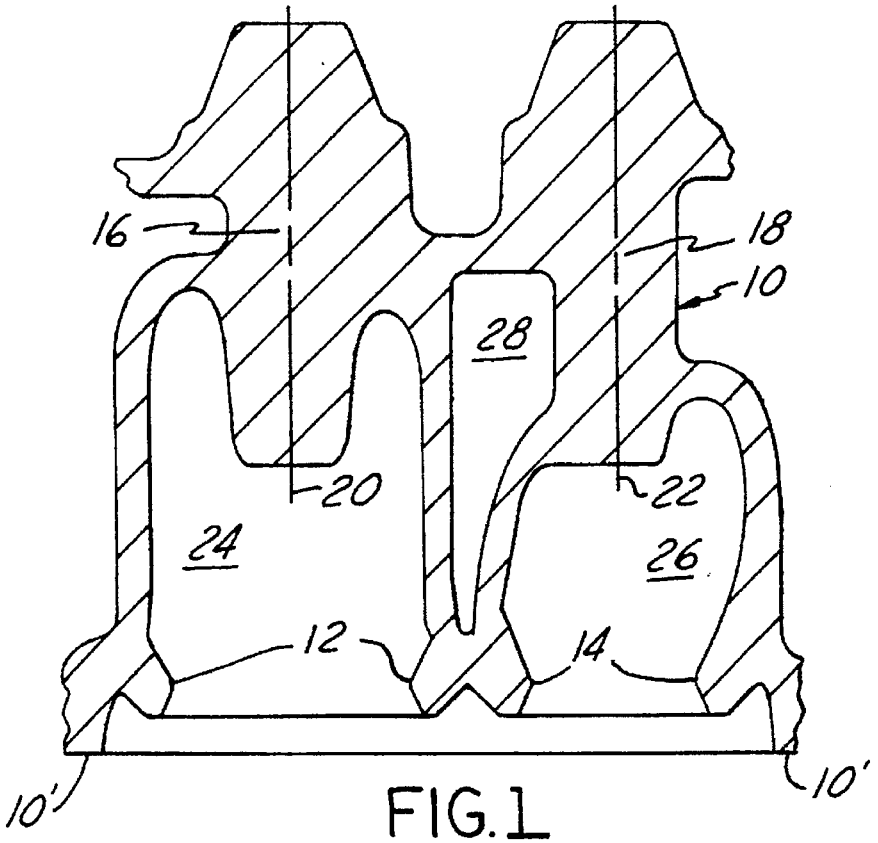
FIG. 1 is a partial elevational sectioned view through a portion of an as-cast aluminum cylinder head prior to any machining or finishing.

In FIG. 1, an as-cast aluminum cylinder head 10 for an internal combustion engine is shown. The cylinder head 10 has a lower surface 10' adapted to mate with an engine block (not shown). The cylinder head 10 has annullarly configured material or rings 12, 14 which are to be subsequently machined for formation of valve seat structure as is conventional with aluminum cylinder heads. The cast cylinder head 10 also includes relatively thick formations of material 16, 18 with axes 20, 22 respectively. The axes 20, 22 extend substantially normal to the plane of the annullarly shaped formations 12, 14. As will be apparant from further reading, the axes 20, 22 correspond to the axes of valve guide bores which eventually will support elongated stem portions of poppet type engine valves (not shown).

As seen in FIG. 1, the formations 16, 18 are offset upward from the plane of annular configurations 12, 14. This structure forms spaces 24, 26 therebetween are recognized by those skilled in the engine art as portions of the inlet passage and exhaust passage, respectively. Also, it can be understood that the cavity 28 is part of a cooling passage formed in the cylinder head.

Figure 2:
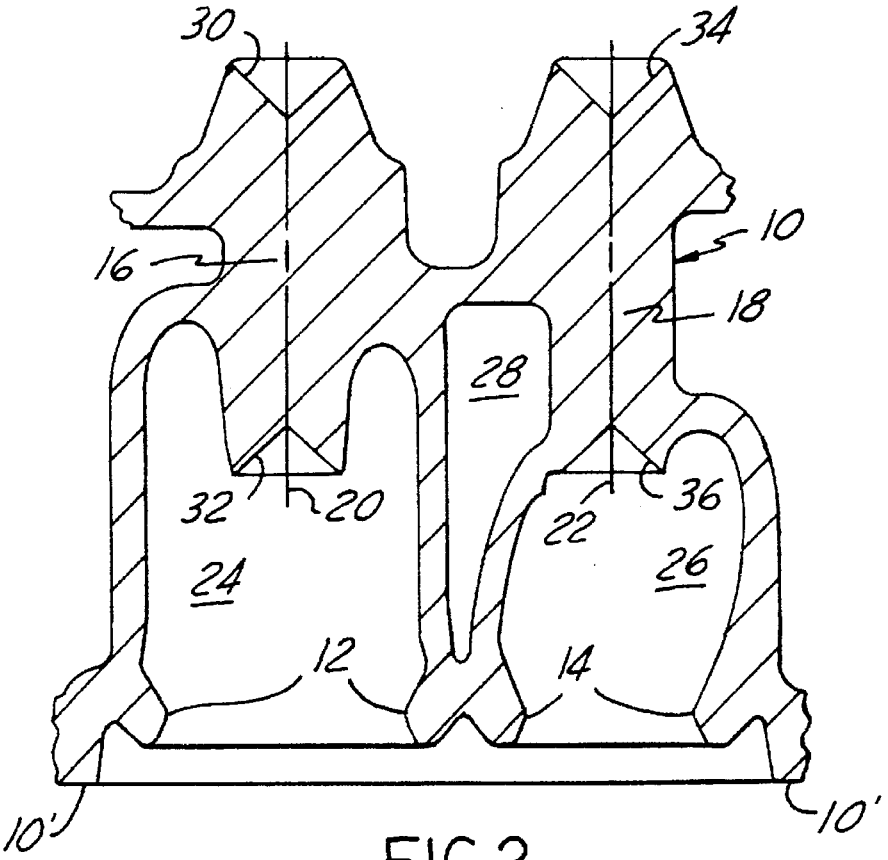
FIG. 2 is a similar view of the aluminum cylinder head showing machining of valve guide pockets into the cylinder head.

In FIG. 2, the upper and lower end portions of formations 16, 18 are shown after cone shaped pockets 30, 32, 34, and 36 are machined in the cylinder head 10. Note that the axes 20, 22 extend through the pockets 30–36.

Figure 3:
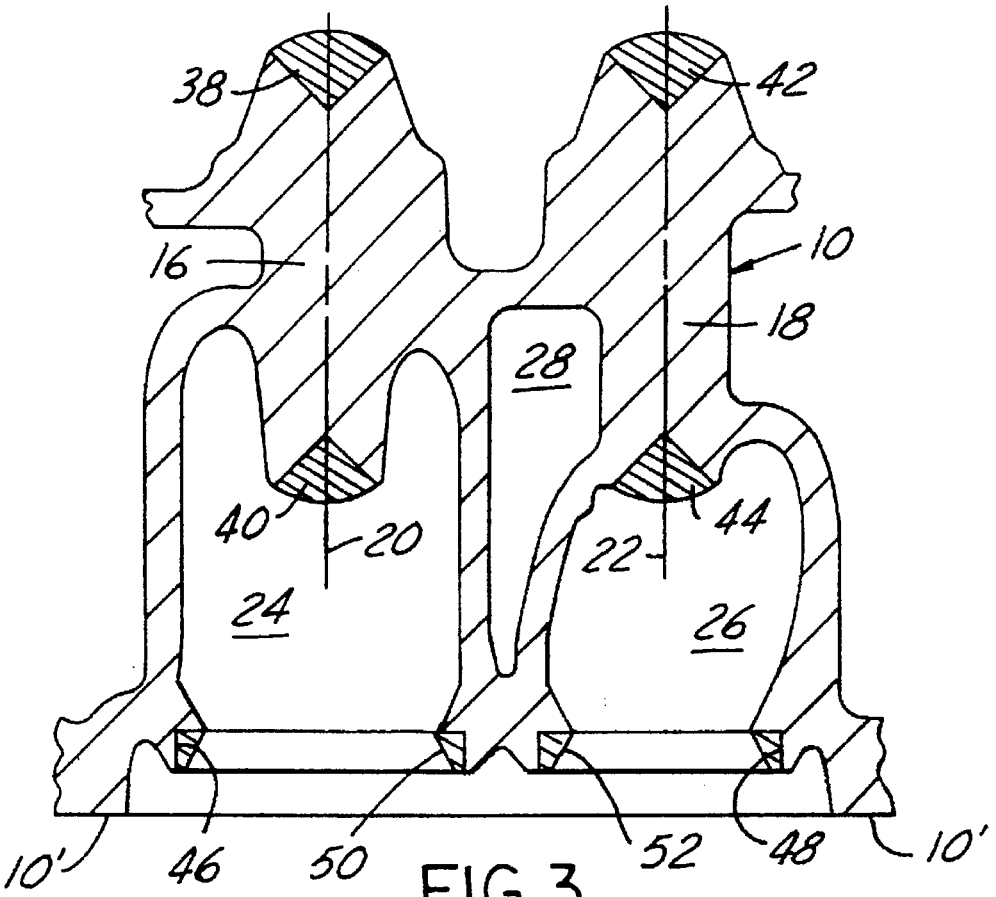
FIG. 3 is a similar view of the aluminum cylinder head showing the deposit of additional metal to fill the pockets previously machined into the head and also showing the formation of the valve seats as is conventional in such cylinder heads.

In FIG. 3, the pockets 30–36 are filled with deposits if metal by the process to be subsequently identified. The deposited metal 38, 40, 42, and 44 is preferrably of a copper based alloy and is relatively hard as compared to cast aluminum alloy which is known to be quite soft and subject to relatively rapid wear by a steel part such as a stem of an engine valve.

Note also in FIG. 3 that the annular formations 12, 14 in the first two views has been machined with recesses 46, 48. Hardened metal valve inserts 50, 52 have been fitted into the recesses to form valve seats for engaging the heads of valves (not shown). This method and apparatus of forming valve seats is known in the engine art and forms no part of the subject invention.

Figure 4:
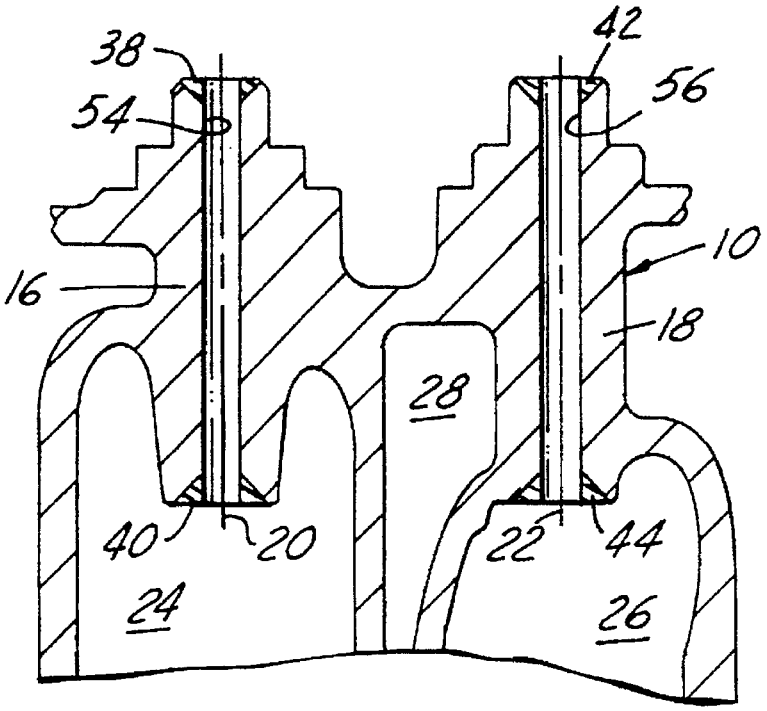
FIG. 4 is a similar view of the aluminum cylinder head showing a first rough or smaller boring of valve guide bores in the cylinder head.

In FIG. 4, rough bore 54 has been formed through deposits 38, 40 and through formation 16 along axis 20. Likewise, a second bore 56 has been formed along the axis 22 through deposits 42, 44 and through formation 18. Note that both bores 54, 56 cut or extend through deposits 38, 40 and 42, 44 respectively. However, formation of the bores 54, 56 leaves an annullus or ring of deposited material at the upper ends and lower ends of bores 54, 56.

Figure 5:
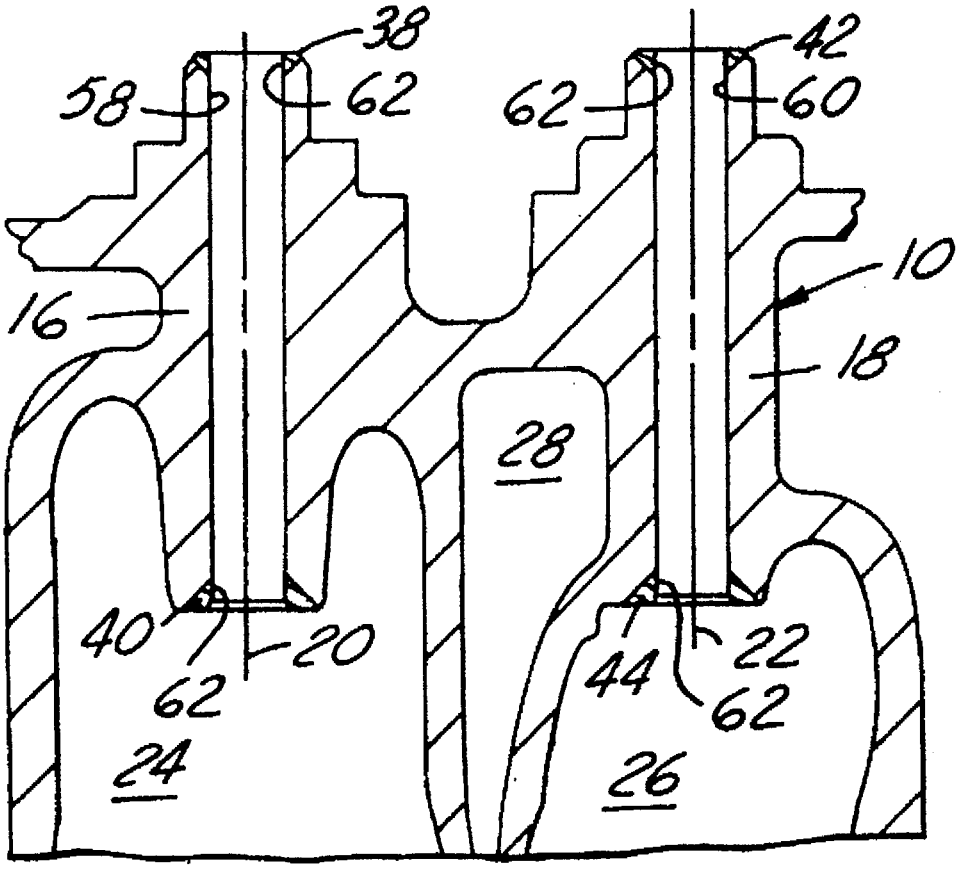
FIG. 5 is a similar view of the aluminum cylinder head showing finish boring of the valve guide bores in the cylinder head leaving end collars of relatively hard deposited metal for resisting wear caused by movement of a valve stem through the bore.

In FIG. 5, finish bores 58, 60 have been formed through the formations 16, 18. The illustrated bores 58, 60 have a diameter larger than rough bores 54, 56 which corresponds to a desired diameters for stems of valves to be supported in the bores 58, 60. Specifically, the end portions of the finnish bores are formed by surfaces 62 through the deposited material 38–44. This material is significantly harder than the as-cast aluminum and will resist the wear of having the valve stems move up and down in the bores 58, 60.

METHOD OF MANUFACTURING

The steps for manufacturing the sleeveless aluminum cylinder head been indicated above in the description of the apparatus but further detail is included hereafter. Obviously, the first step is casting the cylinder head of aluminum. As previously stated, cast aluminum has insufficent hardeness to provide a durable cylinder head capable of long resisting wear by movement of a steeel valve stem in a bore. For example, a cylinder head may be cast of and aluminum alloy having: 2–4% copper; 5–7% silicon; and 2–4% magnesium.

A second step is illustrated in FIG. 2. Although a cone shaped depression or pocket is shown in the drawing, other configureations may be equally useable as long as the radial extent of the pocket extends far enough out relative to the diameter of the finnish bore to leave a substantial amount of deposited matel for wearing engagement with the valve stem.

The third step as shown in FIG. 3 involves actually depositing a metal alloy in the pocket so that the depression is filled. The process is described in the above identified U.S. Pat. No. 4,723,518 to Kawasaki et al. Basically, it consists of using a $CO_2$ laser beam to melt a powder metal of copper based alloy which is laid over the aluminum base. This copper based alloy as described in the patent is much more wear resistant than the base aluminum alloy cylinder head itself.

The fourth step shown in FIG. 4 is to rough bore the valve guide hole through the deposited metal ends and through the aluminum alloy inbetween. The fifth step as shown in FIG. 5 is simply boring or finishing the valve guide bore to arrive at the desired diameter corresponding to the diameter of the associated valve stem.

Although only a single embodiment of the subject valvetrain drive apparatus has been illustrated in the drawings and described in detail above, modifications will be readily apparent to one skilled in the art and the invention is to be described and defined by the following claims.

I claim:

1. An improved aluminum alloy cylinder head of relatively soft and readably worn aluminum alloy material having a valve guide bore for supporting a harder stem portion of a valve, the valve guide bore being formed integral with the cylinder head with a pair of harder portions formed at ends of the bore so as to create spaced wear resistant surfaces for enhancing the wear resistance of the bore to rubbing by movement of the harder valve stem against the cylinder head, the improvement comprising: a cylinder head cast from aluminum alloy; a pair of dissimilar metal portions formed at opposed, spaced surfaces of said cylinder head of dissimilar metal of a cooper based alloy which is harder than said aluminum cylinder head; said cylinder head having a valve guide bore extending through the aluminum alloy of said cylinder head and also through the pair of dissimilar metal portions thereby creating opposite end portions of said valve guide bore with a pair of annularly shaped end portions of different metal alloy integral with the aluminum alloy of said cylinder head.

* * * * *